US005789693A

United States Patent [19]

Lawson

[11] Patent Number: 5,789,693

[45] Date of Patent: Aug. 4, 1998

[54] LOUDSPEAKER SYSTEM FOR ELECTRONIC PIANO

[75] Inventor: Robert D. Lawson, Des Moines, Iowa

[73] Assignee: Van Koevering Company, Des Moines, Iowa

[21] Appl. No.: 784,096

[22] Filed: Jan. 15, 1997

[51] Int. Cl.[6] ..... G10H 1/32; G10H 3/00

[52] U.S. Cl. ..... 84/744; 84/DIG. 1; 84/DIG. 17; 381/24; 381/90; 381/118

[58] Field of Search ..... 84/177, 718, 743, 84/744, DIG. 1, DIG. 17; 381/24, 118, 88, 90; 455/350; D14/172, 194, 204

[56] References Cited

U.S. PATENT DOCUMENTS

| | | | |
|---|---|---|---|
| D. 322,089 | 12/1991 | Orris | 84/177 X |
| 3,643,000 | 2/1972 | Andersen | 84/DIG. 1 X |
| 4,058,045 | 11/1977 | Jennings et al. . | |
| 5,031,500 | 7/1991 | Koike et al. | 381/118 X |
| 5,335,283 | 8/1994 | Torii | 381/118 |
| 5,374,775 | 12/1994 | Kawamura et al. . | |

*Primary Examiner*—William M. Shoop, Jr.
*Assistant Examiner*—Jeffrey W. Donels
*Attorney, Agent, or Firm*—Quarles & Brady

[57] ABSTRACT

An electronic piano, comprises: a sound box having a configuration as in a stringed piano; an electronic keyboard carried by the sound box; an amplifying system; and, a control system for the electronic keyboard and the amplifying system. In a configuration corresponding to an upright piano, the sound box has first and second tweeters mounted through the top and directed upwardly, first and second mid-range speakers mounted through the rear wall and directed rearwardly, and first and second woofers directed angularly toward respective front-bottom corners of the sound box. The front wall has two openings through which sound reverberating inside the sound box is emitted. In a configuration corresponding to a grand piano, the sound box has first and second tweeters mounted on the bottom and directed upwardly, first and second mid-range speakers mounted through the bottom and directed downwardly, third and fourth mid-range speakers mounted on the bottom and directed upwardly, first and second woofers mounted through the bottom and directed downwardly, and third and fourth woofers mounted on the bottom and directed upwardly.

1 Claim, 2 Drawing Sheets

20
4
5
6
3
30
32

42
44
38
40
26

22
34
29

28
36
27

24
25

LOUDSPEAKER SYSTEM FOR ELECTRONIC PIANO

BACKGROUND OF THE INVENTION

1. Field of the Invention

This invention relates to loudspeaker systems for electronic pianos, configured as both upright and grand stringed pianos, and in particular, to a loudspeaker arrangement which accurately models sounds reproduced by stringed pianos, both upright and grand.

2. Description of Related Art

Thus far, no arrangement of loudspeakers in an electronic piano, configured either as an upright piano or a grand piano, has succeeded in accurately modeling the sound and acoustic performance of a conventional stringed piano.

SUMMARY OF THE INVENTION

It is an object of the invention to provide an arrangement of loudspeakers in an electronic piano, configured either as an upright piano or a grand piano, which accurately model the sound and acoustic performance of a conventional stringed piano.

An electronic piano, in accordance with an inventive arrangement, comprises: a sound box having a configuration as in a stringed piano; an electronic keyboard carried by the sound box; an amplifying system; a control system for the electronic keyboard and the amplifying system; and, a plurality of loudspeakers driven by the amplifying system and mounted in the sound box in positions which model sound reproduction of the stringed piano, the loudspeakers including a plurality of tweeters, a plurality of mid-range speakers and a plurality of woofers.

In a first embodiment, the configuration of the sound box corresponds to an upright piano, having a front wall facing the keyboard, a rear wall opposite the front wall, left and right side walls, a top and a bottom. The sound box has first and second tweeters mounted through the top and directed upwardly, first and second mid-range speakers mounted through the rear wall and directed rearwardly, and first and second woofers directed angularly toward respective front-bottom corners of the sound box. The front wall has two openings through which sound reverberating inside the sound box is emitted.

In a second embodiment, the configuration of the sound box corresponds to a grand piano, having a front wall facing the keyboard, a bottom, a curved side wall connecting opposite ends of the front wall and a hinged cover having a closed position and at least one opened position. The sound box has first and second tweeters mounted on the bottom and directed upwardly, first and second mid-range speakers mounted through the bottom and directed downwardly, third and fourth mid-range speakers mounted on the bottom and directed upwardly, first and second woofers mounted through the bottom and directed downwardly, and third and fourth woofers mounted on the bottom and directed upwardly.

DETAILED DESCRIPTION OF THE PREFERRED EMBODIMENTS

Figure 1:
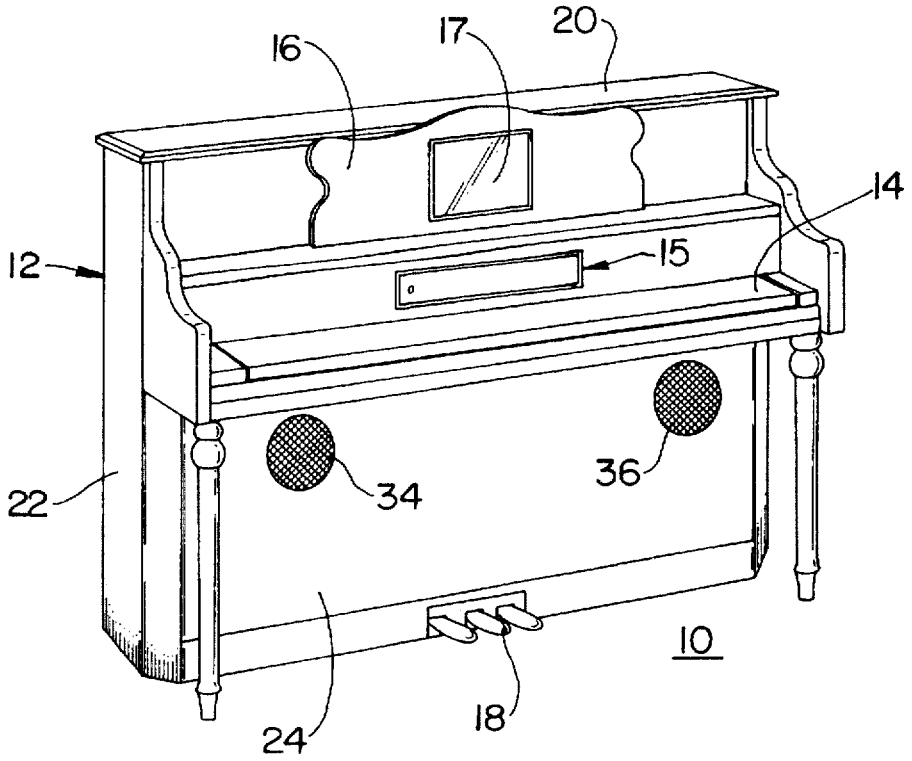
FIG. 1 is a perspective view of an electronic piano having a configuration of a stringed upright piano.

An electronic piano 10 configured to have the appearance of a conventional stringed upright piano, in accordance with a first inventive arrangement, is shown in FIG. 1. The electronic piano has a sound box 12, which is a rectangular space forming the bulk of the piano. An electronic keyboard 14 extends outwardly form the sound box in a forward direction. An amplifying system and a control system for the electronic keyboard and the amplifying system are merely indicated diagrammatically by reference numeral 15, which indicates part of a housing. Parts of the amplifying and control system 15 can be mounted in various parts of the piano structure, including the sound box. The amplifying and control system are not shown in detail. It is noted that most such control systems have means for receiving and processing diskettes, compact discs and the like. A plurality of loudspeakers are driven by the amplifying system. The piano also has a music stand 16, which can be fitted with a user control interface 17. Foot pedals 18 complete the appearance of an upright piano, and also provide input signals to the control system.

Figures 2, 3, 4, 5, 6:
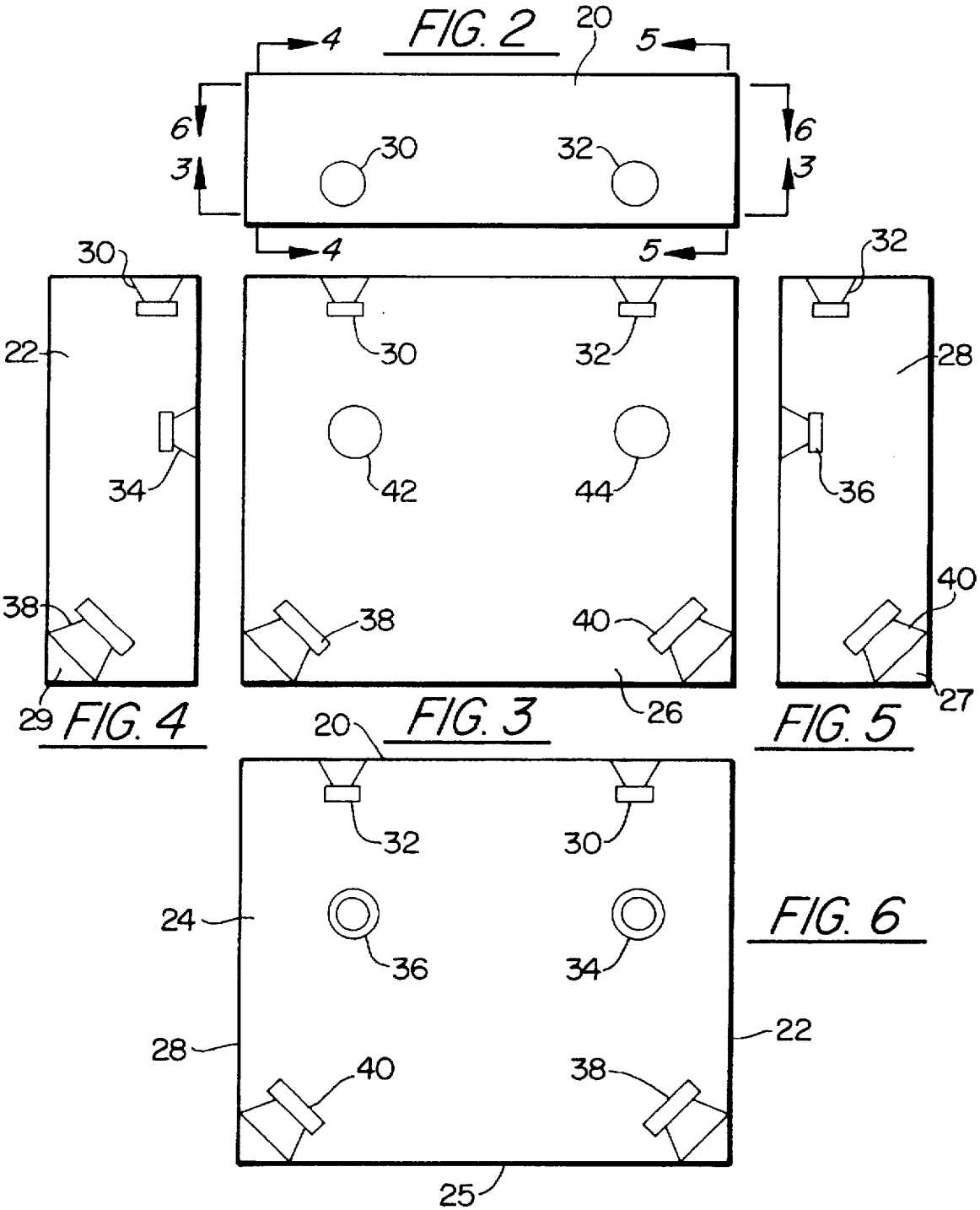
FIG. 2 is a top view of the sound box of the piano shown in FIG. 1.
FIG. 3 is a section view taken along the line 3—3 in FIG. 2.
FIG. 4 is a section view taken along the line 4—4 in FIG. 2.
FIG. 5 is a section view taken along the line 5—5 in FIG. 2.
FIG. 6 is a section view taken along the line 6—6 in FIG. 2.

With additional reference to FIGS. 2–6, the sound box 12 has a front wall 24, a rear wall 26 opposite the front wall, a left side wall 22 and a right side wall 28 joining the front and rear walls, a top 20 and a bottom shown as edge 25 in FIG. 6.

The sound box 12 has tweeters 30 and 32 mounted through the top 20 and directed upwardly. Mid-range speakers 34 and 36 are mounted through the rear wall 26 and directed rearwardly. Woofers 38 and 40 are directed angularly toward respective front-bottom corners 27 and 29 of the sound box 12. The corner 27 is formed by the right side wall 28, the front wall 24 and the bottom 25. The corner 29 is formed by the left side wall 22, the front wall 24 and the bottom 25. The front wall has two openings 42 and 44 through which sound reverberating inside the sound box 12 is emitted. Accordingly, the sound box is closed, except for openings 42 and 44.

The arrangement of loudspeakers shown in FIGS. 2–6, and described above, has been found to very closely model the sound and acoustic response of a conventional stringed upright piano.

What is claimed is:

1. An electronic piano, comprising:

a sound box having a configuration including a front wall, a rear wall facing opposite said front wall, left and right side walls, and a top and bottom;

an electronic keyboard carried by said sound box;

an amplifying system;

a contol system for said electronic keyboard and said amplifying system; and a plurality of loudspeakers driven by said amplifying system and mounted in said sound box, said loudspeakers including first and second tweeters mounted through the top of said sound box and directed upwardly, first and second mid-range speakers mounted through the rear wall of said sound box and directed downwardly, and first and second woofers directed angularly toward respective front-bottom corners of said sound box, and said front wall having two openings through which sound reverberating inside said box is emitted.

* * * * *